US005324114A

United States Patent [19]

Vinci

[11] Patent Number: 5,324,114

[45] Date of Patent: * Jun. 28, 1994

[54] TEMPERATURE AND PRESSURE SENSOR FOR COOLING SYSTEMS AND OTHER PRESSURIZED SYSTEMS

[75] Inventor: Peter Vinci, Kennett Square, Pa.

[73] Assignee: Waekon Industries, Inc., Kennett Square, Pa.

[ * ] Notice: The portion of the term of this patent subsequent to Mar. 22, 2011 has been disclaimed.

[21] Appl. No.: 815,971

[22] Filed: Jan. 2, 1992

[51] Int. Cl.[5] ..... G01K 1/14; G01K 13/00

[52] U.S. Cl. ..... 374/208; 73/45.8; 73/756; 374/145; 374/146

[58] Field of Search ..... 73/45.8, 49.7, 756; 215/247, 248, 249, 260; 220/DIG. 16, DIG. 32; 374/145, 146, 208

[56] References Cited

U.S. PATENT DOCUMENTS

| | | | |
|---|---|---|---|
| 1,776,170 | 9/1930 | Thimblethorpe . | |
| 3,100,391 | 8/1963 | Mansfield | 73/40 |
| 3,255,631 | 6/1966 | Franks | 374/143 |
| 3,313,144 | 4/1967 | Johnson | 73/49.7 |
| 3,566,696 | 3/1971 | Maddison et al. | 73/420 |
| 3,797,317 | 3/1974 | Peterson, Jr. | 73/756 |
| 4,096,754 | 6/1978 | Beveridge, Jr. et al. | 73/432 R |
| 4,235,100 | 11/1980 | Branchini | 73/49.7 |
| 4,458,523 | 7/1984 | Moyer | 73/49.7 |
| 4,622,851 | 11/1986 | Wilson | 374/208 X |
| 4,634,017 | 1/1987 | Kilayko | 220/DIG. 32 |
| 4,638,668 | 1/1987 | Leverberg et al. | 73/866.5 |
| 4,667,507 | 5/1987 | Eriksson | 73/49.7 |
| 4,679,424 | 7/1987 | Tubman | 220/DIG. 32 |
| 4,691,669 | 9/1987 | Otteman et al. | 374/145 X |
| 4,702,620 | 10/1987 | Ford | 374/145 |

FOREIGN PATENT DOCUMENTS

| | | | |
|---|---|---|---|
| 0801735 | 9/1958 | United Kingdom | 73/756 |
| 0944496 | 12/1963 | United Kingdom | 73/756 |

*Primary Examiner*—William A. Cuchlinski, Jr.
*Assistant Examiner*—W. Morris Worth
*Attorney, Agent, or Firm*—Lackenbach Siegel Marzullo & Aronson

[57] ABSTRACT

A device for monitoring the temperature and pressure of a liquid coolant in a cooling system having a sealant which seals around a needle from a pressure or temperature probe and re-seals itself upon removal of the needle. The sealant is fitted within an axial bore within the monitoring device. The needles of the pressure and temperature probes puncture the sealant and are adapted to be in communication with the cooling system. The monitoring device further includes a pressure relief probe for rapid decrease of the cooling system pressure. The invention may be for testing a closed pressurized system using the pressure probe with a valve or other orifice for pressurizing the system.

17 Claims, 8 Drawing Sheets

TEMPERATURE AND PRESSURE SENSOR FOR COOLING SYSTEMS AND OTHER PRESSURIZED SYSTEMS

BACKGROUND OF THE INVENTION

This invention pertains to an apparatus for monitoring the internal pressure of a cooling system which uses liquid coolant to facilitate temperature reduction, such as automotive cooling systems, and for measuring the temperature of the liquid coolant. This invention also pertains to an apparatus for pressurizing systems and detecting leaks.

There are a variety of potential problems associated with cooling systems which use liquid coolant to facilitate temperature reduction. In order to diagnose these problems, it is useful to measure the temperature of the coolant and pressure of the cooling system during its cycle. It is also advantageous for the system to have the capability to pressurize the cooling system as needed. Also, because the cooling system is a closed system, these measurements should be taken while keeping the coolant isolated from the ambient environment.

U.S. Pat. No. 3,255,631 to Franks discloses a pressure/temperature indicating apparatus attached to a radiator cap with a sealing mechanism. This sealing mechanism includes a spring which bears against a metal washer, serving to seal the radiator with a rubber washer.

U.S. Pat. No. 3,100,391 to Mansfield discloses a pressure and temperature indicator of an automotive cooling system. This system is adapted to fit over a radiator cap, and may pressurize the radiator cooling system by the use of a pump. Also, a valve stem can be used to pressurize the system with pressurized air.

U.S. Pat. No. 4,702,620 to Ford discloses an electronic thermostat which monitors the temperature of the coolant in a radiator over time. A temperature sensor is inserted through a cap-like device adapted to fit over the opening of the radiator.

U.S. Pat. No. 1,776,170 to Thimblethorpe discloses a device for indicating the level and temperature of the liquid in radiators of automotive vehicles. The structure has a cap-like device which fits over the opening of a radiator, and includes a temperature sensor and a level sensor.

In these systems, it is important to properly and completely seal the coolant from the ambient atmosphere. Thus, the method of sealing the sensors which are inserted through the closure device is vital to the operation of the system. In cooling systems which are sealed and do not have an opening member for a cap, a need also exists to incorporate a modular unit for monitoring the temperature and pressure of the coolant, while maintaining seal integrity. Similarly, a need also exists to be able to conveniently pressurize and monitor the pressure of a pressurized system, while maintaining seal integrity.

SUMMARY OF THE INVENTION

The present invention is a device for monitoring the temperature of a liquid coolant and the pressure of a cooling system. The monitoring device includes a body, which is removably attached to the cooling system at its opening member and has a bore in fluid communication with the coolant. A sealant, capable of being punctured, is fitted within the bore, and seals around a needle while punctured and seals itself after removal of the needle.

The monitoring device includes a temperature probe having a temperature gauge and a needle, which is adapted to be inserted into the sealant and adapted to be in fluid communication with the coolant. The monitoring device also includes a pressure probe having a pressure gauge and a needle, which is adapted to be inserted in the sealant and adapted to be in fluid communication with the interior of the cooling system.

According to an alternative embodiment of the invention, the monitoring device is adapted for use in a sealed liquid cooling system which has no opening member for a cap. This embodiment includes a body having a bore and a device for rigidly coupling the body to the cooling system in a manner so that the bore is in fluid communication with the coolant. Within the bore is fitted a sealant, which is capable of being punctured, and re-seals itself after and while being punctured. This embodiment also includes temperature and pressure probes.

According to another alternative embodiment of the invention, the pressure probe and the body containing a sealant are used in conjunction to pressure test various systems. In this embodiment, the pressure probe includes a device for pressurizing the system with compressed gas to check for leaks throughout the system and its components. The needle of the pressure probe is adapted to be inserted in the sealant and adapted to be in fluid communication with the interior of the cooling system. In this way, the internal pressure of the system can be monitored both during and after pressurizing the system.

According to a preferred embodiment of the invention, the sealant is a resilient, tear-resistant material. In a further preferred embodiment, the sealant is a resilient, tear-resistant hydrocarbon rubber.

DETAILED DESCRIPTION OF THE INVENTION

One embodiment of the present invention is a device for monitoring the internal pressure of a closed cooling system which uses a liquid coolant to facilitate reducing temperature, and for monitoring the temperature of the liquid coolant. Such cooling systems define an interior which is isolated from the ambient environment during operation. The coolant, usually a mixture of water and antifreeze, occupies a portion of the interior of the cooling system.

The invention may be used in connection with a variety of liquid cooling systems, including liquid cooling systems of automobiles, airplanes, water vehicles, battle vehicles (such as tanks), among others. In fact, any liquid cooling system which has a pre-existing opening with a neck and lip, on which may be seated a cap, is appropriate for use in connection with this embodiment of the invention. For convenience, the invention will occasionally be referred to in its use in connection with automotive cooling systems.

The monitoring device includes a body which can be removably attached to the pre-existing opening member. The body has a bore which is in fluid communication with the coolant and in which is fitted a sealant. The sealant is capable of being punctured and closes and seals the interior of the cooling system from the ambient environment after and while being punctured.

The monitoring device may also include a temperature probe having a temperature gauge and a needle, which is adapted to be inserted into the sealant and to be in fluid communication with the coolant. The monitoring device may also include a pressure probe which has a pressure gauge and a needle, which is adapted to be inserted into the sealant and to be in fluid communication with the interior of the cooling system.

Figure 1:
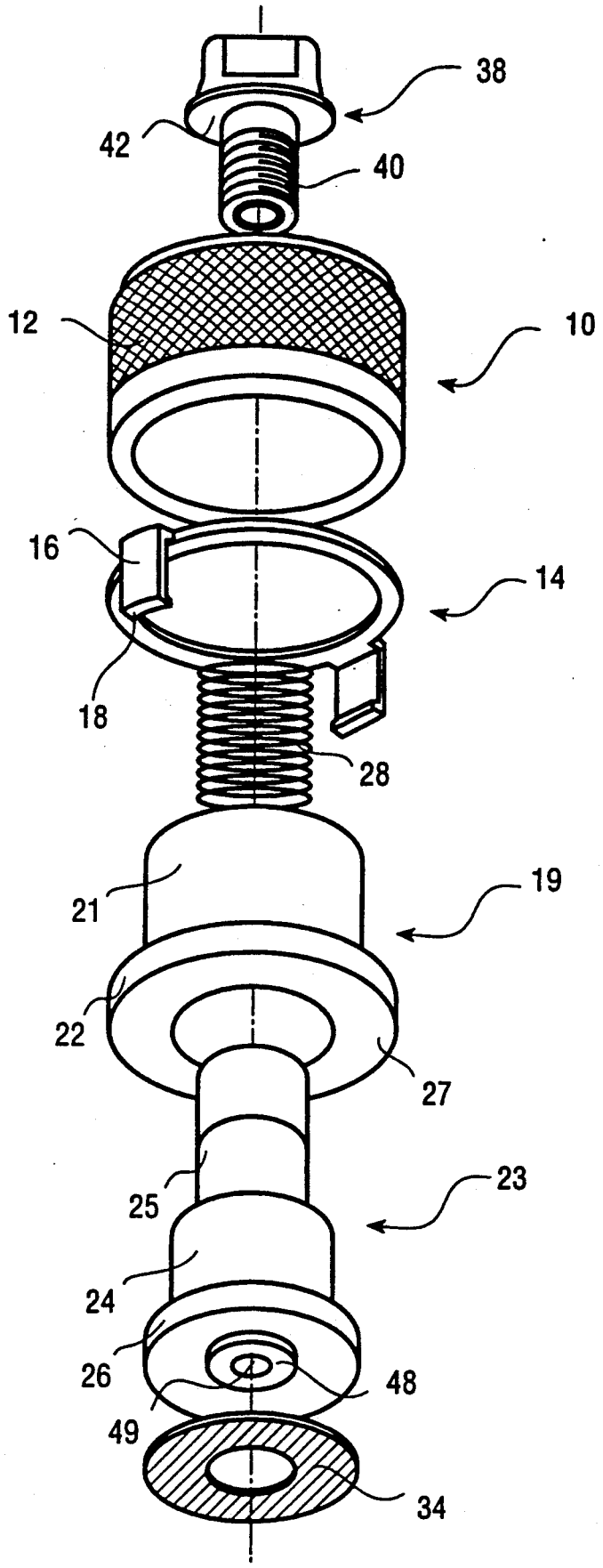
FIG. 1 is an exploded perspective view of the components which comprise the body of one embodiment of the present invention.
Figure 2:
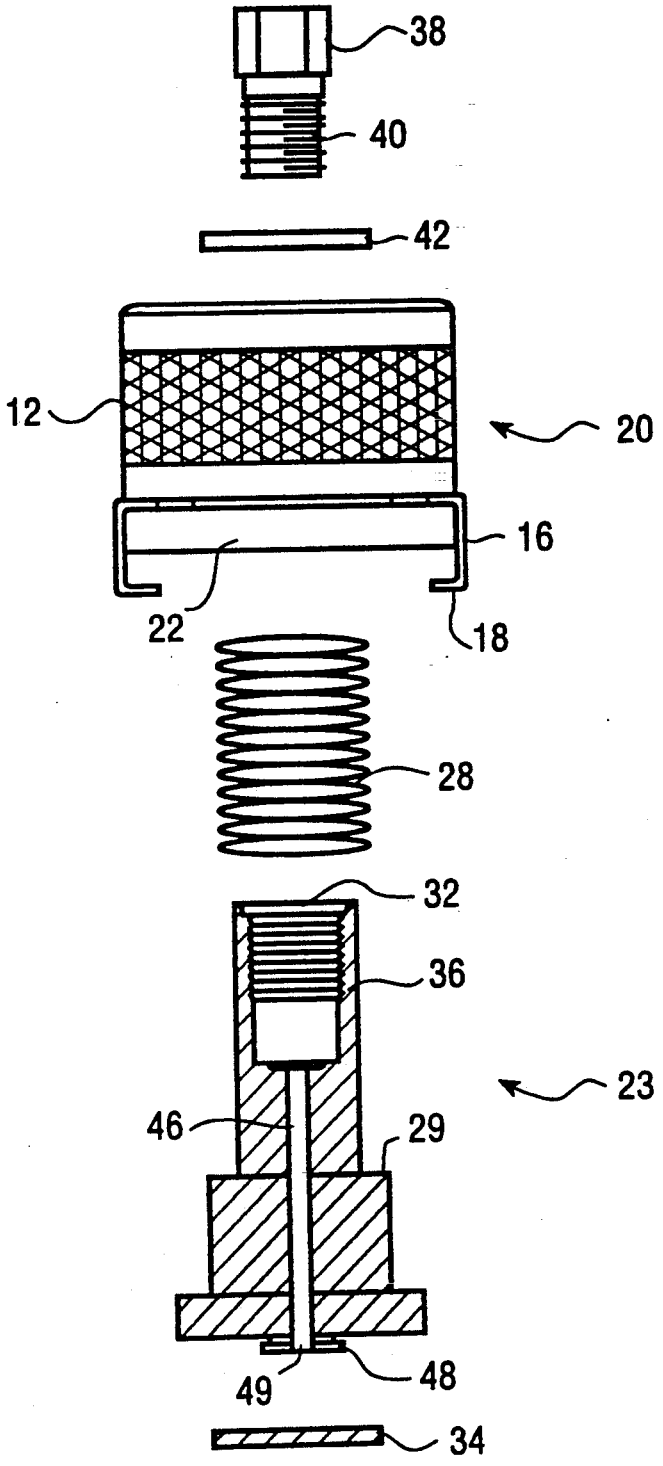
FIG. 2 is an exploded partial cross section of the components which comprise the body as shown in FIG. 1.

FIG. 1 shows this embodiment of the present invention. This embodiment includes a cylindrical housing 10 having a knurled grip 12. Cylindrical housing 10 includes a circular top portion with an opening (not shown) and may be anodized aluminum. Washer-shaped coupling member 14 is permanently affixed to housing 10, as shown in FIG. 2. Coupling member 14 includes two H-shaped downwardly extending flanges 16, each of which includes an inwardly protruding tab 18. Flanges 16 and tabs 18 may be stainless steel.

Figure 3A:
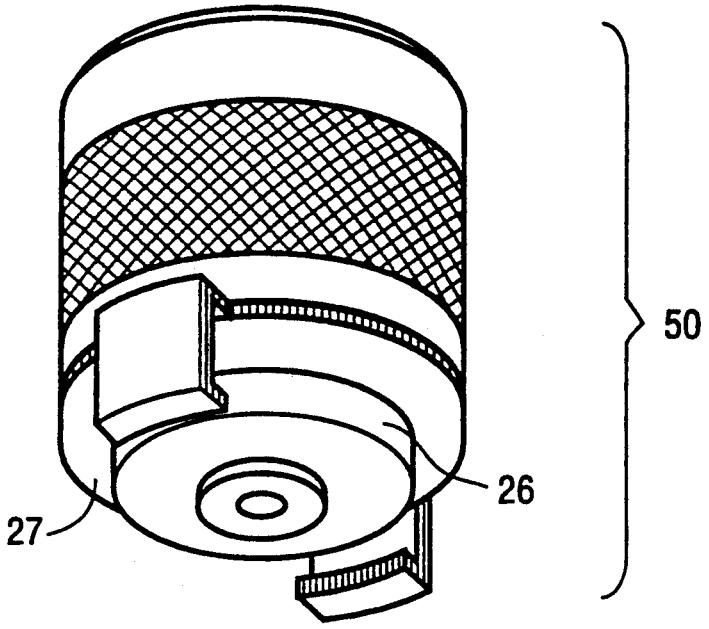
FIG. 3*a* is a compressed perspective view of a body comprising the components shown in FIGS. 1 and 2.

A sleeve 19, which may also be anodized aluminum, includes an upper portion 21 having a diameter adapted to fit within coupling member 14 and cylindrical housing 10. Sleeve 19 also includes an outwardly extending ring 22, which is adhered to coupling member 14 when the elements are collapsed, as shown in FIGS. 2 & 3*a*.

Cylindrical housing 10, coupling member 14, and sleeve 19 adhere to one another to form boss 20, as shown in FIG. 2. The method of adhering these three elements may include interference press fitting of housing 10 and sleeve 19, which locks coupling member 14 permanently between them. Flanges 16 extend radially outward relative to ring 22.

This embodiment also includes a spindle 23, which has an upper portion 25, a middle portion 24, and an outwardly extending ring 26. Upper portion 25 and middle portion 24 fit within upper portion 21 of sleeve 19. Outwardly extending ring 26, does not fit within this sleeve 19, but abuts shoulder 27 of sleeve 19, when these elements are collapsed, as shown in FIG. 3. Spindle 23 may be brass.

As shown in FIG. 2, spindle 23 defines an upper bore 32 and a lower bore 46. Each bore may be substantially cylindrical, and the bores, in combination, extend the length of spindle 23. A pressure/temperature plug 38 is adapted to extend through the opening of the top portion (not shown) of housing 10 and fit within upper bore 32 of spindle 23. Threads 40 of pressure/ temperature plug 38 engage the threads 36 formed within the interior of upper portion 25 of spindle 23, defining upper bore 32. Lower bore 46 permits fluid communication between upper bore 32 and port 49, which is an opening on disc 48 (shown in both FIGS. 1 and 2). Disc 48 serves to couple rubber washer 34 to the bottom of spindle 23.

As shown in FIGS. 1 and 2, a spring 28 has a diameter such that it will contact shoulder 29 of middle portion 24 of spindle 23 and the circular top portion (not shown) of housing 10 of boss 20. Spring 28 is biased to exert downward force on shoulder 29 of middle portion 24 of spindle 23 and upward force on boss 20. Upward axial motion of boss 20 relative to spindle 23 is confined by brass washer 42, because brass washer 42 abuts pressure/temperature plug 38 which is in threaded engagement with spindle 23. Brass washer 42 includes a circular hole (not shown) through which extends pressure temperature plug 38. Alternatively, brass washer 42 and pressure/temperature plug 38 may be made from one piece of metal.

In FIG. 3*a*, the components shown in FIGS. 1 and 2 are collapsed to form a body 50. In FIG. 3*a*, spring 28 is completely compressed so that outwardly extending ring 26 of spindle 23 abuts shoulder 27 of sleeve 19. As spring 28 is compressed, boss 20 (and therefore cylindrical housing 10) moves axially downward along spindle 23 in the direction of outwardly extending ring 26.

Figure 3B:
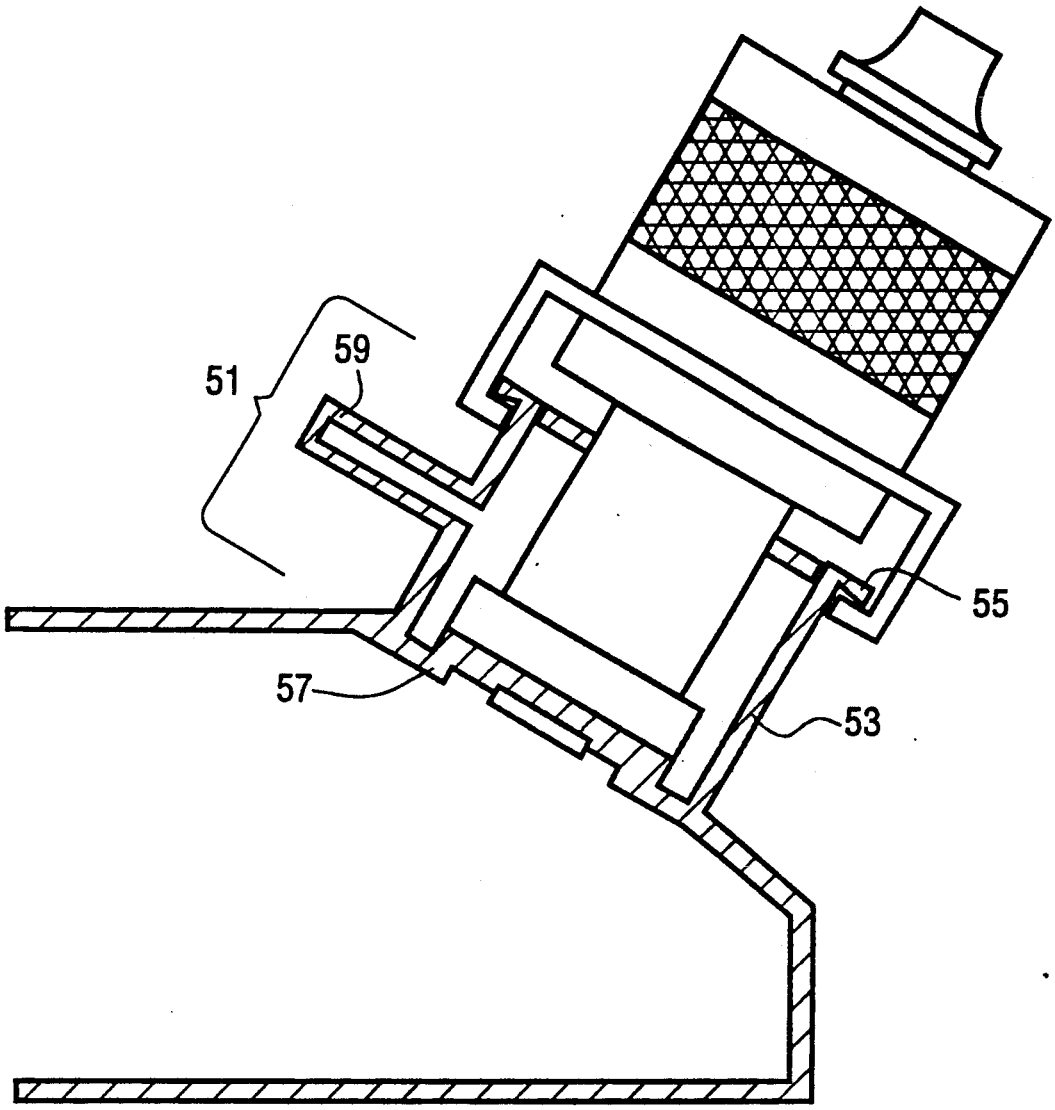
FIG. 3*b* is a partial cross section of the body as shown in FIG. 3*a*, showing the connection between the body and an opening member of a cooling system.

FIG. 3*b* demonstrates how body 50 is attached to an opening member 51 of a liquid cooling system, such as a radiator. Opening member 51 includes a neck 53 at the upper edge of which is an outwardly extending lip 55, a ledge 57, and an overflow orifice 59. Lip 55 includes recesses (not shown) through which may be inserted tabs 18 of flange 16. To secure body 50 to opening member 51, the operator first aligns tabs 18 with the recesses, exerts downward pressure on body 50, and turns body 50 by grasping knurled grip 12 to permit tabs 18 to contact lip 55.

In this way, rubber washer 34 contacts ledge 57 with downward force exerted by spring 28. This seals the interior of the liquid cooling system. The downward force exerted by spring 28 may result in a pressure equivalent to the critical design pressure of the cooling system. The critical design pressure of a cooling system is the maximum pressure recommended for safe testing of the cooling system. The critical design pressure varies with the materials and design of the cooling system. Testing at pressures above this critical design pressure may result in structural or other damage to the cooling system.

If the cooling system pressure exceeded this critical design pressure, then spring 28 will contract under the increased pressure of the cooling system. This safely allows pressure release from the cooling system to the ambient environment through overflow orifice 59. Body 50 may include other devices for venting the cooling system to the ambient environment if the cooling system pressure exceeds its critical design pressure.

Figure 4:
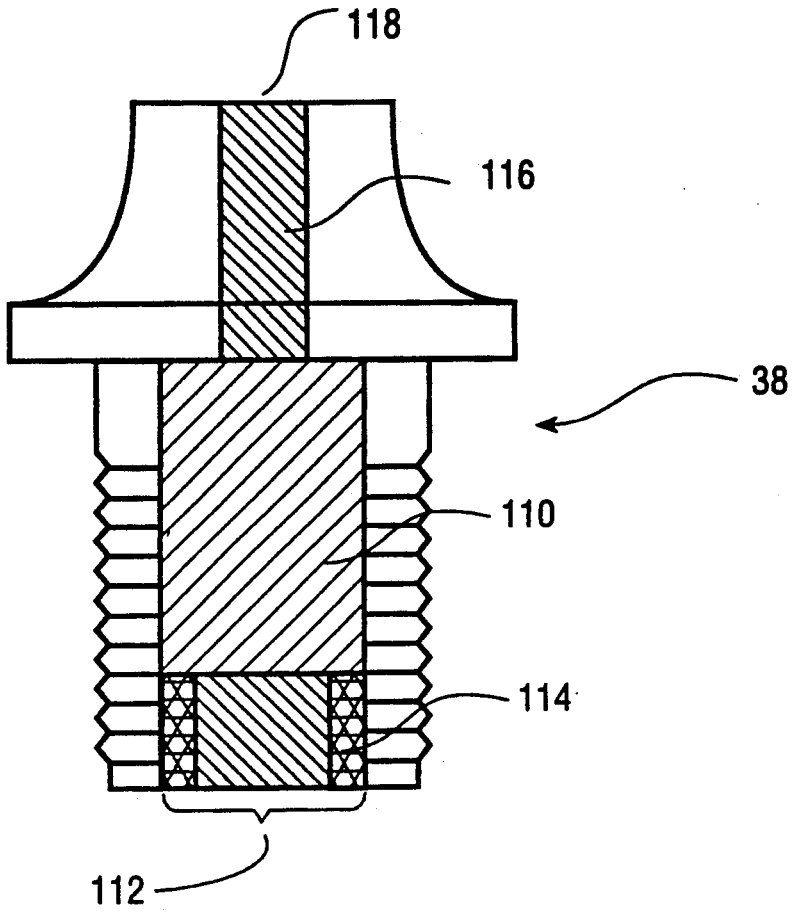
FIG. 4 is a cut-away view of the pressure/temperature plug as shown in FIGS. 1 and 2.

FIG. 4 is a cut-away view of pressure/temperature plug 38. As shown, sealant 110 is positioned within a lower bore 112 of plug 38. Sealant 110 may be press-fitted within lower bore 112 by transmitting pressure across retaining collar 114 to sealant 110. Retaining collar is affixed to plug 38 and keeps sealant 110 in place. Upper bore 116 of plug 38 extends from sealant 110 to port 118, which leads to the ambient environment. Upper bore 116 and lower bore 112 of plug 38 and lower bore 46 of spindle 23 in combination form a "body bore" which extends the axial length of body 50.

Sealant 110 is a resilient, tear- resistant material. This material must be capable of being punctured and of sealing around a needle inserted into it and of re-sealing itself after the removal of a needle. In this way, the sealant seals the cooling system from the ambient environment after and while being punctured. A rubber with these characteristics is suitable. Preferably, the material is NORDEL hydrocarbon rubber, which is an elastomer based on an ethylene-propylene-hexadiene terpolymer. Other materials appropriate for this sealant are neoprene $(C_4H_5Cl)_n$, VITON rubber, and BUNA-N nitrile rubber.

Figure 5:
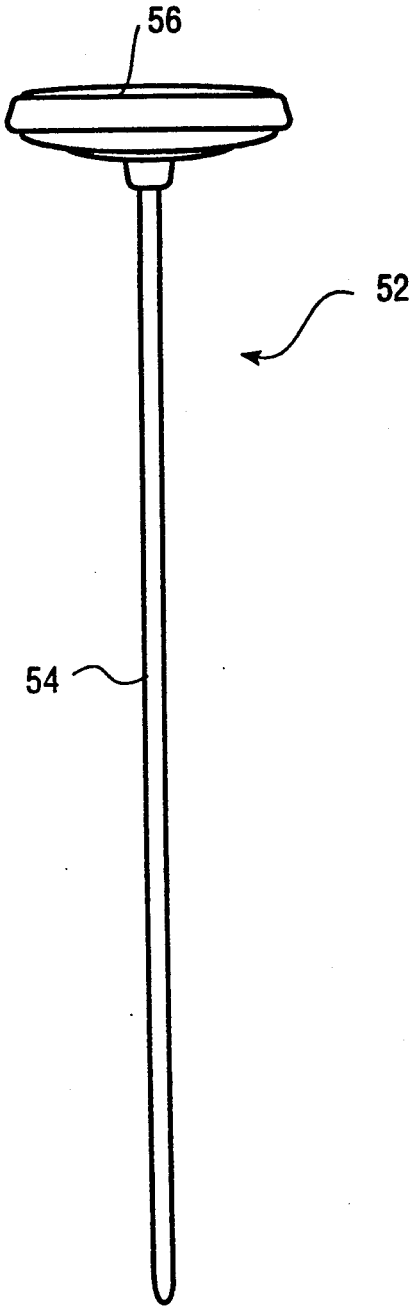
FIG. 5 is a perspective view of a temperature probe which may be used in the present invention.

FIG. 5 is a perspective view of temperature probe 52. Temperature probe 52 includes a needle 54 and a gauge 56 for indicating the temperature. Needle 54 is sufficiently long so that it contacts the liquid coolant upon insertion through sealant 110.

Figure 6:
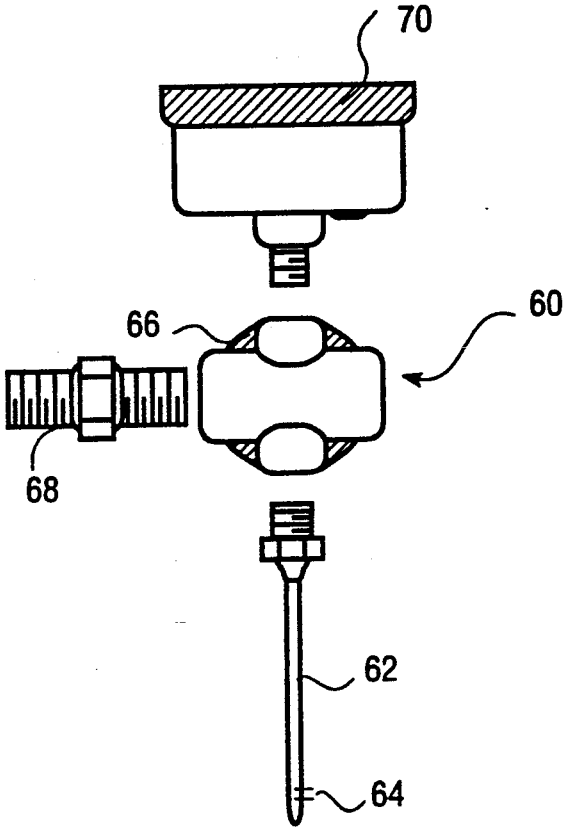
FIG. 6 is a perspective view of a pressure probe which may be used in the present invention.

FIG. 6 is a perspective view of a pressure probe 60. Pressure probe 60 includes a needle 62 which is adapted to be inserted into the sealant fitted within bore 32 of pressure temperature plug 38. Needle 62 is sufficiently long to extend into bore 49, so that opening 64 is in fluid communication with the interior of the cooling system.

Pressure probe 60 also includes a regulator 66. Regulator 66 and a pressurized gas source are capable of pressurizing the cooling system to the critical pressure of the cooling system. This critical pressure may be approximately 16 psi. A check valve 68 is inserted into an opening (not shown) of regulator 66. Pressurized air may be injected into the cooling system by screwing an air hose source onto check valve 68. The internal pressure of the cooling system is displayed at pressure gauge 70.

Figure 7:
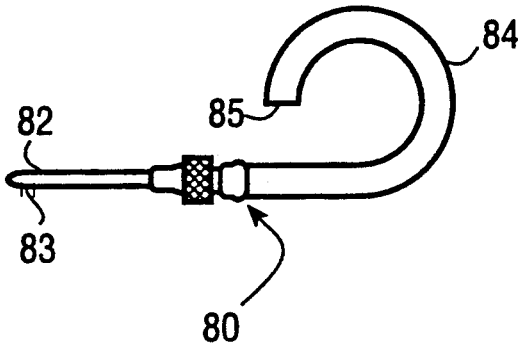
FIG. 7 is a perspective view of a pressure relief probe which may be used in the present invention.

FIG. 7 shows a pressure relief probe. Pressure relief probe 80 includes a needle 82. Needle 82 is adapted to be inserted into sealant 110. Needle 82 is sufficiently long so that opening 83 of needle 82 will extend into bore 46, so that opening 83 is in fluid communication with the interior of the cooling system. Opening 83 and the interior of needle 82 are in fluid communication with tube 84. Tube 84 has an open end 85 which leads to the ambient environment.

In operation, body 50 is coupled with opening member 51 by an operator as discussed above. Then, the system to be cooled, such as an automobile engine, may be activated, and the pressure and temperature variations may be monitored throughout its cycle. Temperature probe 52 may be inserted by centering needle 54 in the pressure temperature plug 38 and applying steady pressure until needle 54 pierces the sealant 110 and engages the coolant liquid. Once the temperature probe is installed, the temperature of the coolant may be monitored while the car is running and under pressure.

Monitoring the temperature of the automobile serves several functions. Monitoring temperature gives the exact operating range of the cooling fan and the thermostat opening of the automobile. If the thermostat does not open, there will be no increase in coolant temperature. If this is the case, an operator should then shut the engine down and replace the thermostat.

If the coolant temperature increases, one should know the temperature at which the thermostat has been set and continue to monitor the temperature until the cooling fan commences operation. If the cooling fan does not begin to operate within the specified range, the operator would recognize that the problem involves a defective cooling fan switch, fan motor or fan relay.

A similar method of installing temperature probe 52 is used to install pressure probe 60. However, needle 62 need not engage the coolant liquid. It is only necessary that opening 64 on needle 62 is in fluid communication with lower bore 46 and therefore with the interior of the cooling system.

Pressure probe 60 is useful if an automobile is losing water and the leak cannot be found. After inserting the pressure probe, the operator should rev up the engine between 1000 and 2000 rpms, noting the pressure gauge. If the needle on the gauge goes either to positive pressure or pulls vacuum, this is an indication of a bad head gasket or a cracked cylinder head.

It is also possible to attach a hose from a pressurized air source to check valve 68. It is preferred that clean air at a constant pressure of 100 psi is applied to the gauge. Deviation from this pressure will cause the regulator to operate at other than specified maximum pressure. Pressures lower than the specified operating pressure will cause the maximum regulated pressure to increase.

As with all air tools, the filter and water separator should be installed on the air supply downstream from the tool location.

Attaching a pressurized air source and slowly dialing in pressure enables the operator to determine whether there are leaks in the cooling system, for example in the water pump, hoses, radiator, heating core, control valve, etc.

After testing a cooling system, the system will remain pressurized. To vent this pressure, an operator may insert pressure relief probe 80 through sealant 110. This allows the pressurized system to vent to the ambient environment.

Preferably, the needles from either the pressure relief probe, the pressure probe, or the temperature probe, are not left in sealant 110 for more than a few consecutive hours. If these needles are left in sealant 110 for an excessive period of time, the sealant, such as NORDEL hydrocarbon rubber, might fail.

According to other embodiments of the invention, body 50 includes different types of coupling members for removable attachment to a cooling system opening member. These different types of coupling members are provided so that the monitoring device may be used with a variety of cooling system opening member types. For example, the coupling member may be adaptable with the cooling systems of American and foreign automobiles, diesel trucks, heavy equipment, farm equipment, and other systems having cooling systems with different opening member types.

Figure 8:
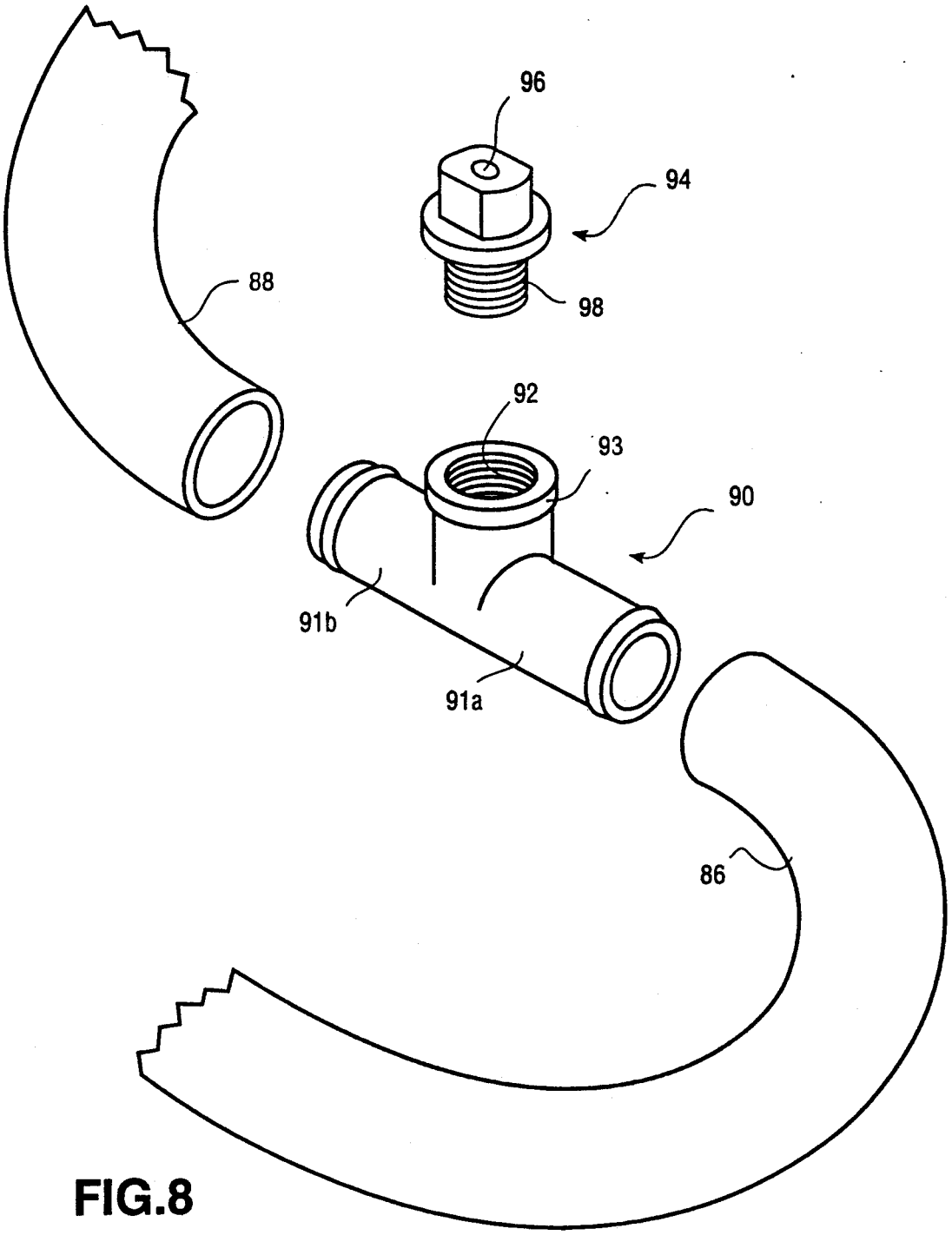
FIG. 8 is a perspective view of a second embodiment of the present invention and cooling system hoses adapted for engagement with this embodiment.

According to another embodiment of the invention, FIG. 8 shows the use of the invention in connection with a sealed liquid cooling system which does not have an opening member. In this embodiment, a T-connector 90, having two arms 91*a* and 91*b*, is provided. Radiator hoses 86 and 88 of a cooling system may be attached to and sealingly engaged with arms 91*a* and 91*b*, respectively. T-connector 90 also includes one leg 93. The interior of leg 93 includes threads 92 which engage the threads 98 of body 94. Body 94 includes a bore 96 in which is fitted a sealant, similar to the sealant previously discussed. The use of body 94 in connection with the pressure probe, temperature probe and pressure relief probe is similar to that use of body 50.

Figure 9:
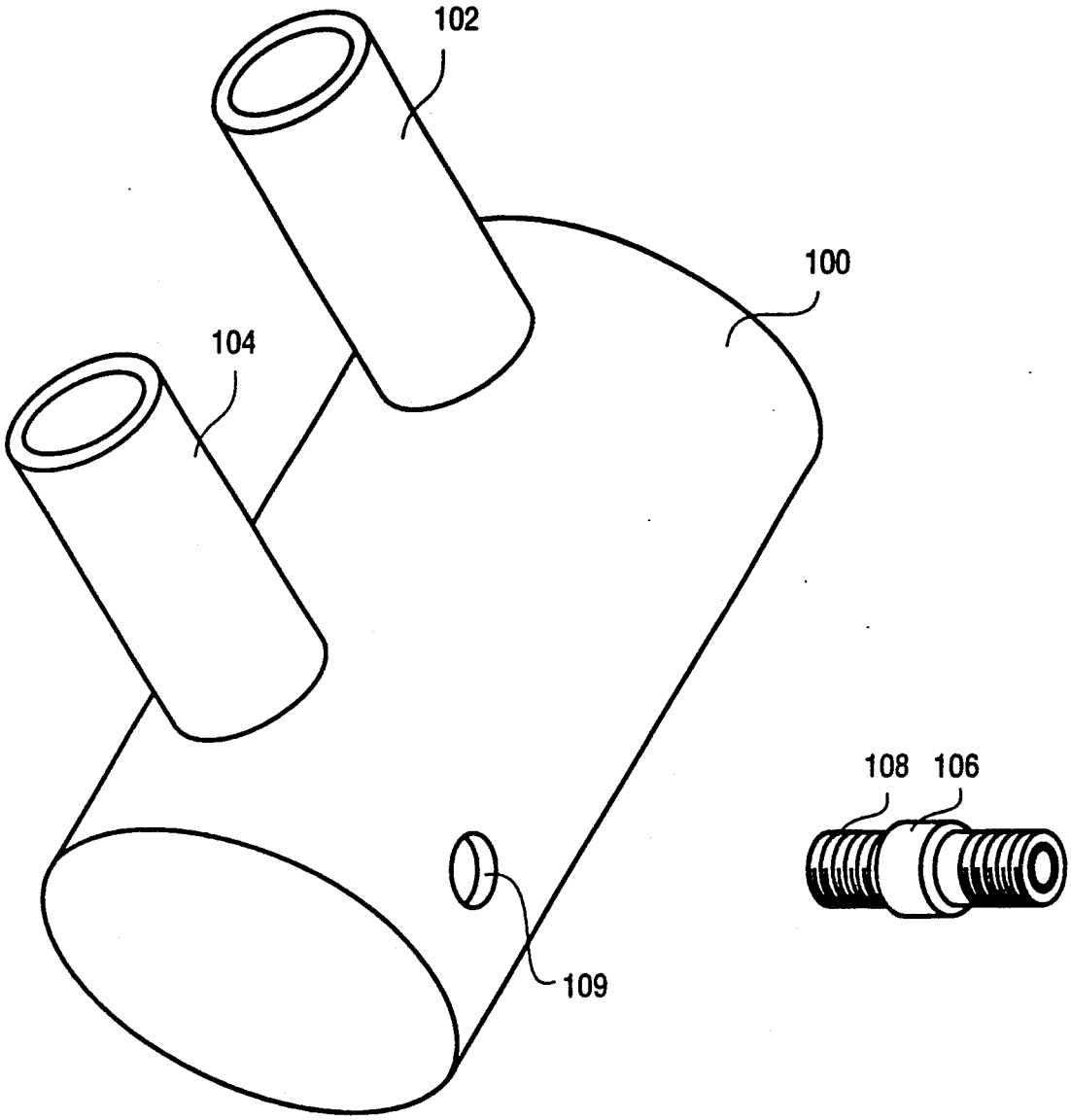
FIG. 9 is a perspective view of a third embodiment of the present invention and a cooling system adapted for engagement with this embodiment.

According to another aspect of the invention, FIG. 9 also shows the use of the invention in connection with a sealed liquid cooling system which does not have an opening member. Here, the body is directly coupled with a wall of the cooling system 100. Cooling system 100 has conduits or hoses 102 and 104. An opening 109 may be formed by using a drill. Threads are formed on the cylindrical wall defining hole 109. These threads engage with threads 108 of a body 106, which may be similar to body 94. With this embodiment, body 50 may be permanently attached to the radiator of an automotive cooling system, and the probes may be conveniently inserted into the interior of the cooling system.

The cooling system analyzer of the present invention is helpful for determining the probable cause of a condition of a cooling system. For example, if the cooling system indicates that there is over heating, one cause may be that there is low coolant. In this case, the operator should merely add coolant and check for leaks. Another possible cause could be that the thermostat is stuck closed. If this is the case, the operator should replace the thermostat and recheck. A third possible cause is that the cooling fan/fan clutch is broken. If this is the case, the operator should check the thermo-fan switch/fan clutch and replace as needed. A fourth possible cause of overheating may be a clogged radiator. If this is the case, the operator should replace it.

The cooling system analyzer may also indicate that no heat is being applied to the cooling system. If this is the case, one possible cause may be that the thermostat is stuck open. If this is the case, the operator should replace the thermostat and recheck. A second possible cause may be that the coolant is low. In this case, the operator should add coolant.

If the cooling system is leaking, the probable cause is that there is a broken heater core, radiator hose, water pump or radiator. In this case, the cooling system analyzer may be used to pressure test the system and replace the defective items as needed.

In the event of a loss of coolant, if a leak is not found, one possible cause is that there is an internal leak. A second possible cause is that the cylinder head gasket or cylinder head is defective. A final possible cause is a defective piston sleeve or sleeve seal. In all three of these cases, the cooling system analyzer may be installed with the pressure measuring device, and the operator may monitor pressure or vacuum at various 'rpms.'

According to another embodiment of the present invention, the body is used in conjunction with the pressure probe to test a closed pressurized system having an interior for pressure leaks. In this embodiment, the pressurized system may be a liquid or a gas system and need not be a cooling system. For example, it may be a gas system (such as oxygen, nitrogen, nitrous oxide, freon, etc.) for use in a hospital, laboratory, among other facilities. The body of this embodiment may be adapted to be coupled with a system with or without an opening member, as discussed above.

In this embodiment, needle 62 of pressure probe 60 is inserted through sealant 110 as discussed above. The appropriate pressurized gas may be selected and applied to the system by means of check valve 68 and regulator 66. Pressurized air may be injected into the system by screwing an air hose source onto check valve 68. After obtaining a desired system pressure, as indicated by pressure gauge 70, the system pressure may continue to be monitored over time to determine whether the system has any leaks.

While this invention has been disclosed with reference to specific embodiments, it is apparent that other embodiments and equivalent variations of this invention may be devised by those skilled in the art without departing from the true spirit and scope of this invention.

What is claimed is:

1. An assembly having a cooling system using a liquid coolant and having a coolant opening member for said coolant, said assembly monitoring pressure of said cooling system, and monitoring temperature of said coolant, comprising:

a body having means for removably attaching said body to said coolant opening member;

said body including a spindle having a bore in fluid communication with said coolant, a housing and a spring, said spindle and said housing being movable relative to one another against force of said spring;

a sealing member, fitted within said bore and formed from a resilient material capable of being sealingly punctured, so as to seal the cooling system from ambient environment after and while being punctured;

means for confining motion of the housing relative said spindle in the direction of said sealing member;

means for measuring temperature having a temperature gauge and a first needle, said first needle adapted to be inserted into said sealing member and to be in fluid communication with said coolant; and means for measuring pressure having a pressure gauge and a second needle, said second needle adapted to be inserted into said sealing member and to be in fluid communication with the interior of said cooling system.

2. The assembly of claim 1, wherein said sealing member is made of a resilient, tear-resistant material.

3. The assembly of claim 2, wherein said material is NORDEL hydrocarbon rubber.

4. The assembly of claim 2, wherein said material is selected from a group of neoprene, VITON rubber or BUNA-N nitrile rubber.

5. The assembly of claim 1, wherein said means for measuring pressure includes means for applying pressure to the cooling system, said means for applying pressure pressurizes the cooling system to a critical design pressure of the system.

6. The assembly of claim 1 wherein said housing has a knurled grip.

7. The assembly of claim 6, wherein the compressive force of said spring results in a pressure equivalent to a critical design pressure of the cooling system.

8. A device for monitoring a condition of a cooling system having an inlet with interior and exterior surfaces, said device comprising:

a spindle;

housing means for receiving said spindle, said housing means including a body having an aperture therethrough and at least two engaging parts extending from said body;

said spindle movable within said aperture, said spindle having at least a receiving portion and an engaging portion, an inner bore formed within the spindle for communication with said cooling system, said inner bore having a first end situated at said receiving portion, said inner bore having a second end at the engaging portion, said spindle being provided with a sealing member surrounding said second end, spring means being interposed between said housing means and said spindle for resisting movement of said spindle within said housing means;

plug means for sealingly permitting insertion of a means for measuring temperature through said inner bore, said plug means being connected to said first end of the inner bore; means cooperating with said spindle and plug means for confining motion of said body relative to said spindle in the direction of said plug means, said means for measuring temperature having a temperature gauge and a needle, said needle adapted for puncturing said plug means which seals said cooling system from an ambient environment after and during the puncturing;

whereby in a working condition of the device said engaging portion of the spindle being sealingly connected to said inlet in such a manner that said at least two engaging parts extending from the body engage the external surface of the inlet, so that said second end of the inner bore is in fluid communication with said cooling system with said sealing member being positioned between said engaging portion and said interior surface of the inlet.

9. A device for monitoring a condition of a cooling system of claim 8, wherein said plug means comprises a resilient, tear-resistant rubber.

10. A device for monitoring a condition of a cooling system of claim 9, wherein said tear-resistant rubber is NORDEL hydrocarbon rubber.

11. A device for monitoring a condition of a cooling system of claim 10, wherein said rubber is selected from a group of neoprene, VITON rubber or BUNA-N nitrile rubber.

12. A device for monitoring a condition of a cooling system having an inlet with interior and exterior surfaces, said device comprising:

a spindle;

housing means for said spindle, said housing means including a body having an aperture therethrough and at least two engaging parts extending from said body;

said spindle movable within said aperture, said spindle having at least a receiving portion and an engaging portion, an inner bore formed within the spindle for communication with said cooling system, said inner bore having a first end situated at said receiving portion, said inner bore having a second end at the engaging portion, said spindle being provided with a sealing member surrounding said second end, spring means being interposed between said housing means and said spindle for resisting movement of said spindle within said housing means;

plug means for sealingly permitting insertion of a mean for measuring pressure through said inner bore, said plug being connected to said first end of the inner bore; means cooperating with said spindle and plug means for confining motion of said body relative to said spindle in the direction of said plug means, said means for measuring pressure having a pressure gauge and a needle, said needle adapted for puncturing said plug means which seals said cooling system from an ambient environment after and during the puncturing;

whereby in a working condition of the device said engaging portion of the spindle being sealingly connected to said inlet in such a manner that said at least two engaging parts of the body engage the external surface of the inlet, so that said second end of the inner bore is in fluid communication with said cooling system with said sealing member being positioned between said engaging portion and said interior surface of the inlet.

13. A device for monitoring a condition of a cooling system 12, wherein said plug means comprises a resilient, tear-resistant rubber.

14. A device for monitoring a condition of a cooling system of claim 13, wherein said tear-resistant rubber is NORDEL hydrocarbon rubber.

15. A device for monitoring a condition of a cooling system of claim 13, wherein said rubber is selected from a group of neoprene, VITON rubber of BUNA-N nitrile rubber.

16. A device for monitoring a condition of a cooling system of claim 12, wherein said means for measuring pressure includes means for applying pressure to the cooling system.

17. A device for monitoring a condition of a cooling system of claim 16, wherein said means for applying pressure is capable of pressurizing the cooling system to the critical design pressure of the system.

* * * * *